US006784419B1

(12) United States Patent
Hayashi et al.

(10) Patent No.: US 6,784,419 B1
(45) Date of Patent: Aug. 31, 2004

(54) ELECTROMAGNETIC WAVE ABSORBER

(75) Inventors: Toshikatsu Hayashi, Saitama-ken (JP); Yasushi Sakai, Saitama-ken (JP)

(73) Assignee: Kabushiki Kaisha Riken, Tokyo (JP)

( * ) Notice: Subject to any disclaimer, the term of this patent is extended or adjusted under 35 U.S.C. 154(b) by 586 days.

(21) Appl. No.: 09/695,974

(22) Filed: Oct. 26, 2000

(30) Foreign Application Priority Data

Oct. 28, 1999 (JP) ..... 11-307200

(51) Int. Cl.[7] ..... H01Q 17/00

(52) U.S. Cl. ..... 250/250; 342/1; 342/2; 342/3; 342/4

(58) Field of Search ..... 250/250; 342/1–4

(56) References Cited

U.S. PATENT DOCUMENTS 5,081,455 A * 1/1992 Inui et al. ..... 342/1
5,276,448 A * 1/1994 Naito et al. ..... 342/4
6,373,425 B1 * 4/2002 Inoue et al. ..... 342/1

* cited by examiner

*Primary Examiner*—John R. Lee
*Assistant Examiner*—Zia R. Hashmi
(74) *Attorney, Agent, or Firm*—Browdy and Neimark

(57) ABSTRACT

The present invention provides a flame-retardant electromagnetic wave absorber that exhibits excellent formability and electromagnetic wave-absorbing properties, and can be easily assembled and constructed. The electromagnetic wave absorber comprises a wave-absorbing body and a base plate supporting the bottom thereof, wherein the wave-absorbing body is formed in a pyramid shape by fitting polygonal wave-absorbing plates into each other.

7 Claims, 12 Drawing Sheets

(a)

(b)

(a)

(b)

ELECTROMAGNETIC WAVE ABSORBER

BACKGROUND OF THE INVENTION

The present invention relates to an electromagnetic wave absorber for use in an anechoic chamber, etc., particularly to a flame-retardant electromagnetic wave absorber that can be easily assembled.

Recently, there have been increasing cases where electromagnetic waves emitted from electronic devices as noise interfere operations of the devices themselves or other devices. In such circumstances, electronic devices manufacturers are demanded to guarantee that their products neither suffer errors by external electromagnetic waves nor emit such electromagnetic waves as to affect nearby devices. Thus, the electronic devices are required to have an electromagnetic compatibility (EMC) to meet the above demand. A chamber used for EMC evaluation is such that metal plates are attached to its outer surface to shield the external electromagnetic waves, and that electromagnetic wave absorbers are attached to its inner surface to prevent the electromagnetic waves from reflecting. Such a chamber is referred to as "anechoic chamber". The anechoic chambers are classified as a larger anechoic chamber for large products such as automobiles and large electronic devices, and a compact anechoic chamber for relatively small electronic devices, etc.

Ferrite tile absorbers and carbon absorbers formed in a pyramid or wedge shape have been well known as the electromagnetic wave absorbers for use in the anechoic chambers. These absorbers are often used in combination. Although the carbon absorbers are generally minimized, correspondingly to electromagnetic wave-absorbing properties thereof and the size of the anechoic chamber, the absorbers for use in the larger anechoic chamber are even 1.5 to 2 m in height.

A "MT-type carbon absorber" and a "hollow-type carbon absorber" have been well known. The full-type carbon absorber is generally obtained by expanding and molding a resin such as urethane resin penetrated with carbon. The hollow-type carbon absorber is generally obtained by assembling or bending carbon mixture boards, usable for the purposes of reducing weight and cost, etc. However, it is remarkably troublesome to produce the carbon absorbers of 1.5 to 2 m in height. Further, a member used for supporting the absorbers or applying them to the anechoic chamber is limited because it cannot be made of electromagnetic wave-reflecting materials such as metals. In a case where the shorter, pyramid- or wedge-shaped carbon absorber having a small base area is applied to the anechoic chamber, etc., the number thereof per a predetermined area is increased. With respect to the hollow-type carbon absorber, its assembling steps are increased with the number to unavoidably increase costs.

With regard to the immunity test recently carried out in the anechoic chamber, the electromagnetic waves with a strong electrical field are radiated to the electromagnetic wave absorber. In general, the electromagnetic wave absorber is extremely heated in the test because electromagnetic energy of the electromagnetic waves is converted to thermal energy. Therefore, the electromagnetic wave absorber is required to have excellent heat resistance and flame retardance. This is also desirable from an architectural point of view, when the electromagnetic wave absorber is applied to the inner wall of the anechoic chamber. However, because most of the conventional carbon electromagnetic wave absorbers are made of carbon dispersed in resins, they are poor in flame retardance, often burning to generate a toxic combustion gas. Though a flame-resistant material may be added to the absorber to increase the flame resistance, the material often causes aging degradation of the absorber for a long time.

To solve the problems mentioned above, carbon electromagnetic wave absorbers comprising inorganic materials such as ceramic fibers, calcium carbonate, cement mortar, etc. were developed. However, these absorbers newly cause problems such as high material cost, heavy weight, poor formability, etc.

OBJECT AND SUMMARY OF THE INVENTION

Accordingly, an objective of the present invention is to provide a flame-retardant electromagnetic wave absorber that exhibits excellent formability and electromagnetic wave-absorbing properties, and can be easily assembled and applied.

As a result of intense research in view of the above objective, the inventors have found that an electromagnetic wave absorber, which is produced by forming a wave-absorbing body in a pyramid shape by fitting (or engaging) a plurality of wave-absorbing plates into each other and disposing a base plate on the bottom thereof, exhibits excellent electromagnetic wave-absorbing properties, formability and flame retardance.

Thus, an electromagnetic wave absorber of the present invention comprises a wave-absorbing body and a base plate supporting the bottom thereof, wherein the wave-absorbing body is formed in a pyramid shape by fitting polygonal wave-absorbing plates into each other.

DETAILED DESCRIPTION OF THE PREFERRED EMBODIMENTS

An electromagnetic wave absorber of the present invention comprises a wave-absorbing body and a base plate supporting the bottom thereof, wherein the wave-absorbing body is formed in a pyramid shape by fitting a plurality of wave-absorbing plates, each having a shape of a polygon such as a triangle and a trapezium, into each other. Disposed on the top of the wave-absorbing body may be an upper plate, if necessary. The wave-absorbing plate and the electromagnetic wave absorber according to the present invention will be described below.

[1] Wave-absorbing Plate

Figure 1:
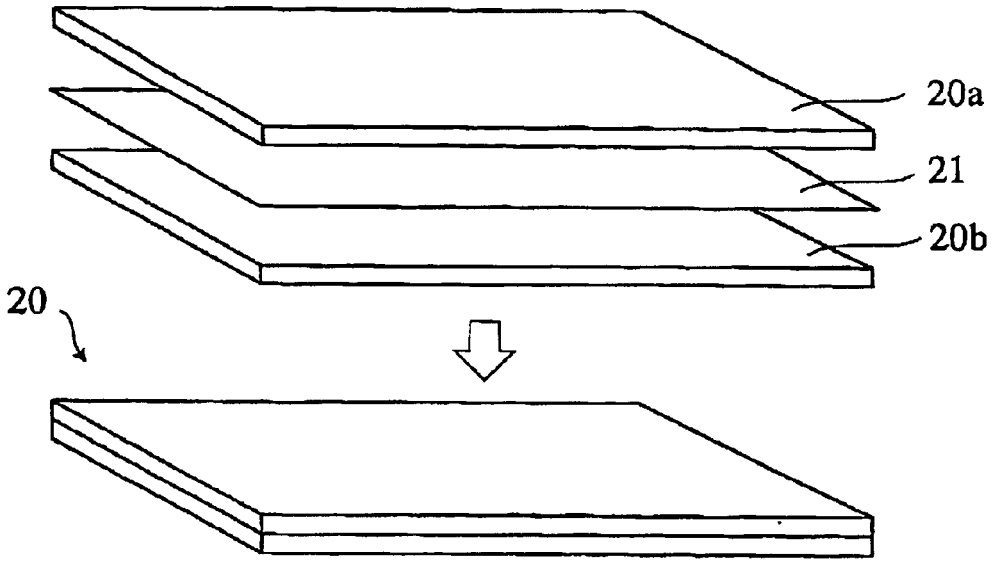
FIG. 1 is a perspective view showing an embodiment of a wave-absorbing plate used in the present invention.

The wave-absorbing plate used in the present invention is preferably composed of a couple of non-combustible boards and an electrically conductive layer sandwiched therebetween. Such a wave-absorbing plate may be prepared by, for example, coating the electrically conductive layer on one non-combustible board and mounting the other non-combustible board to the layer. As shown in FIG. 1, the wave-absorbing plate 20 may be prepared by sandwiching a carbon sheet 21 of a carbon-dispersed resin between the non-combustible boards 20*a* and 20*b*.

The wave-absorbing plate may be cut into a shape of a triangle, a quadrangle, a trapezium, a tapered polygon, etc. depending on its use, like the wave-absorbing plates 2, 2*a*, 5, 6, 7, 8 and 12 shown in FIGS. 2 to 12. The non-combustible boards may be made of the same or different materials. It is preferable that the non-combustible board is mainly made of inorganic materials. The non-combustible board is more preferably made of a foamed material mainly composed of calcium carbonate. The electrically conductive layer is preferably an electrically conductive sheet made of carbon powder or fiber dispersed in a resin. The electrically conductive sheet is preferably prepared, for example, by mixing carbon powder and a polypropylene resin, and using conventional sheet-forming processes.

In the case of using the carbon sheet as the electrically conductive layer, the wave-absorbing plate can be easily and economically prepared by a usual molding and laminating method without complicated processes. Such a wave-absorbing plate can be easily engaged each other to form the wave-absorbing body described below. The wave reflection and absorption properties of the wave-absorbing plate depend on the carbon sheet, so that the properties and use conditions can be diversified by controlling the kind and/or amount of carbon.

According to a preferred embodiment of the present invention, the electrically conductive layer is made of a resin penetrated with carbon. The resin acts to eliminate the problems of moldability. The non-combustible board mainly composed of an inorganic material generally has a few binders, in particular, such that composed of an inorganic material having a large surface area and a small diameter, or a fibrous inorganic material is poor in moldability. In contrast, the wave-absorbing plate containing a resin can be easily formed by various forming methods with little restriction, so that the plate can find wide application.

[2] Electromagnetic Wave Absorber

The wave-absorbing body used for the electromagnetic wave absorber of the present invention may be formed by fitting (or engaging) and adhering polygonal wave-absorbing plates to each other without particular tools. Therefore, the electromagnetic wave absorber can be easily assembled at a construction site. Although the conventional, hollow, pyramid-shaped, electromagnetic wave absorber is generally formed of four wave-absorbing plates, the wave-absorbing body used in the present invention is basically formed of only two wave-absorbing plates as exemplified in FIG. 2, remarkably reducing the number of assembling steps. The wave-absorbing plate used in the present invention may be piled up, so that it can be more efficiently transported and carried to a construction site than the conventional plates assembled in a pyramid shape beforehand.

Figure 2:
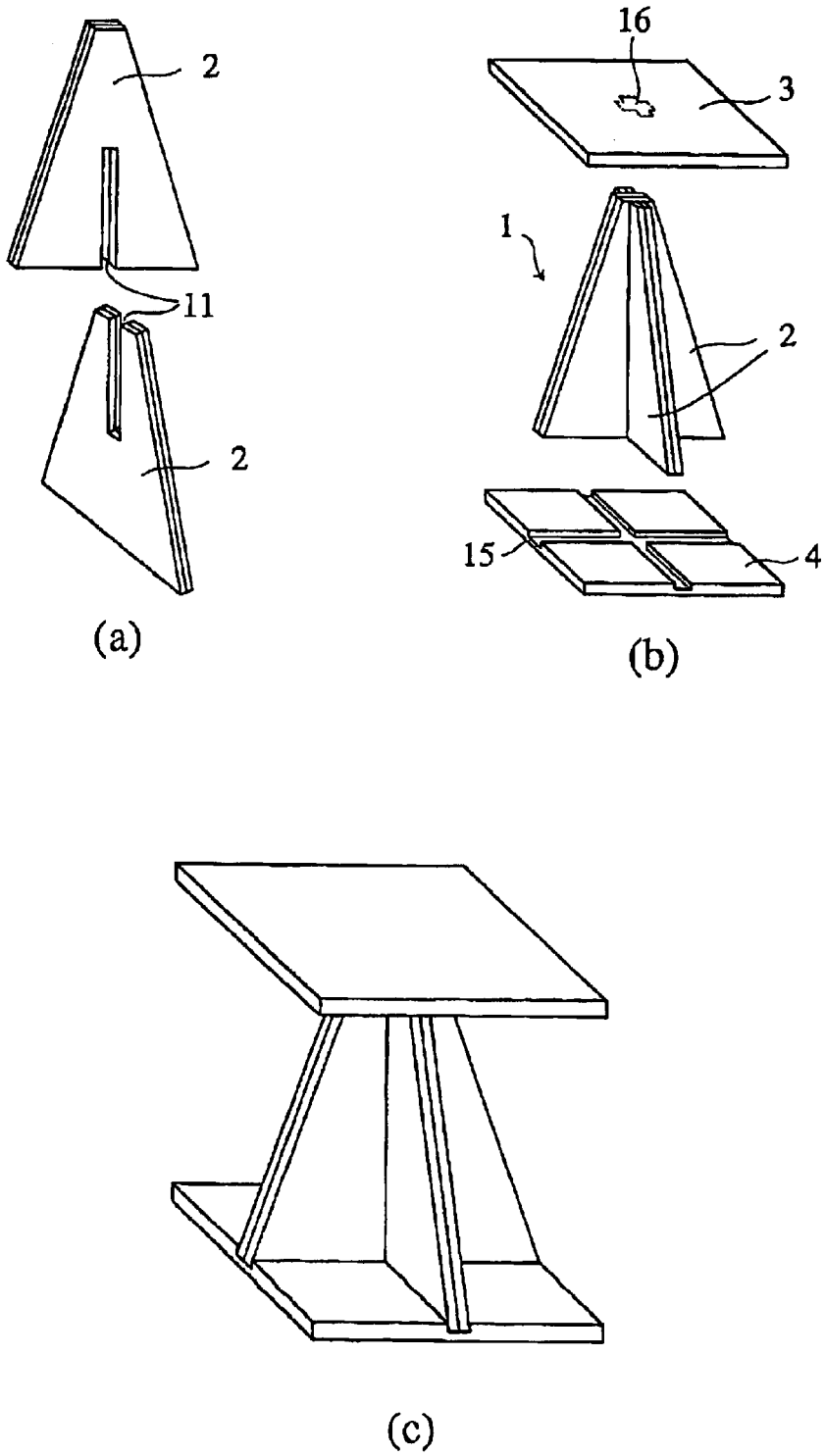
FIG. 2 is a perspective view showing production of an electromagnetic wave absorber of EXAMPLE 1 according to the present invention, wherein (a) shows wave-absorbing plates before engaging, (b) shows a wave-absorbing body, an upper plate and a base plate, and (c) shows the resultant electromagnetic wave absorber.
Figure 3:
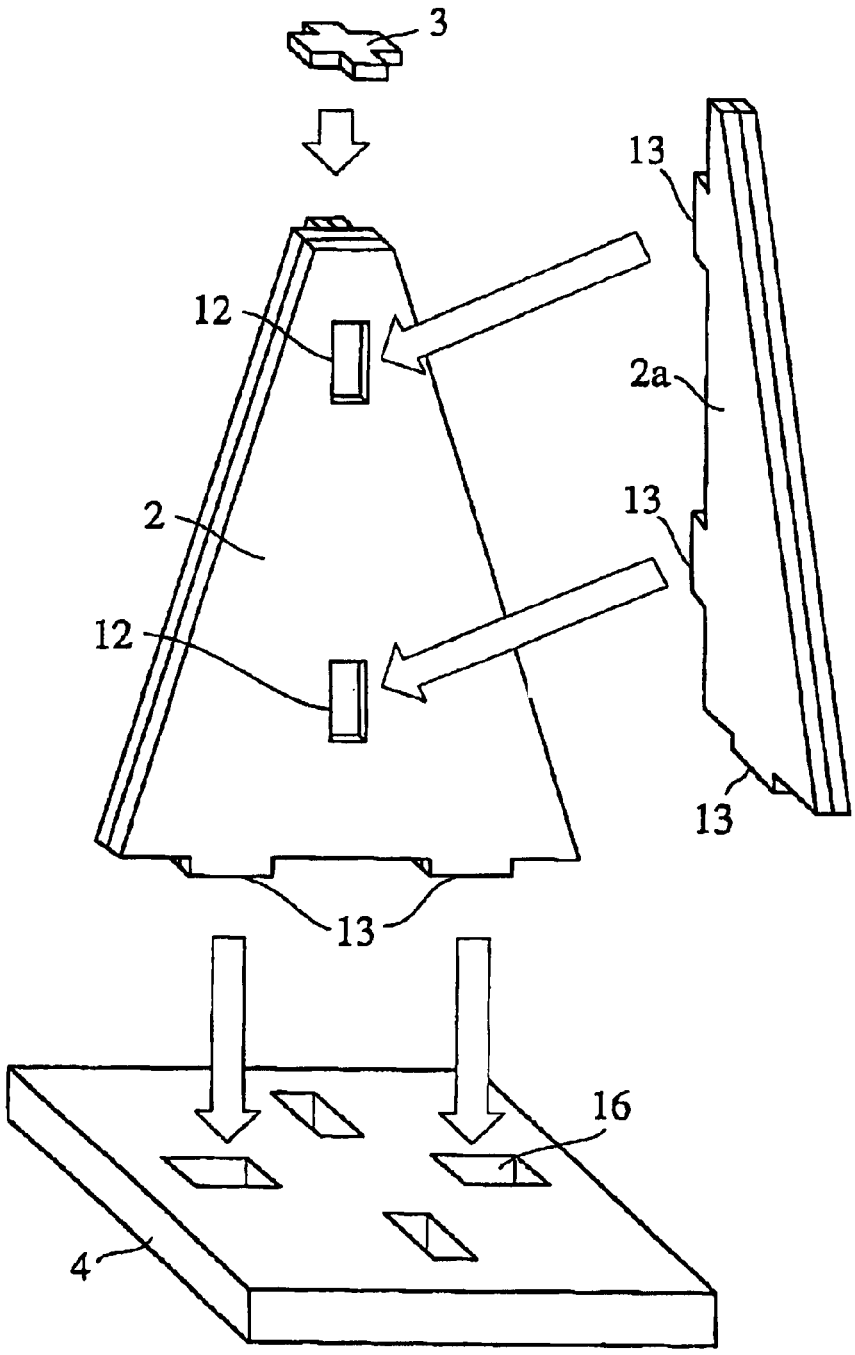
FIG. 3 is a perspective view showing production of an electromagnetic wave absorber of EXAMPLE 2 according to the present invention.

As shown in FIG. 2(*a*), the wave-absorbing body 1 may be formed by fitting a polygonal wave-absorbing plate 2 having a notch in an upper portion to a polygonal wave-absorbing plate 2 having a notch in a lower portion through their notches in a crossing manner. Instead, the wave-absorbing body may be formed as shown in FIG. 3 by fitting wave-absorbing plates 2*a* into fitting-apertures 12 in the wave-absorbing plate 2.

In a case where the wave-absorbing body is formed by fitting two wave-absorbing plates to make them intersect, the direction of intersection is not particularly limited and may be changed corresponding to the desired properties. The wave-absorbing body may be formed of three or more wave-absorbing plates while changing the shape of the notches, the apertures, etc.

Disposed on the bottom of the wave-absorbing body is a base plate, with an upper plate disposed on the top thereof if necessary. These plates are preferably disposed by fitting to be easily assembled. The upper plate and the base plate are preferably composed of materials that reflect few electromagnetic waves. The materials may be the same as those for the wave-absorbing plate. As shown in FIG. 2(*b*), it is preferred that the upper plate 3 and the base plate 4 have a fitting-shape such as a groove 15 and an opening 16 to be easily fitted with the top or bottom of the wave-absorbing body 1.

Figure 4:
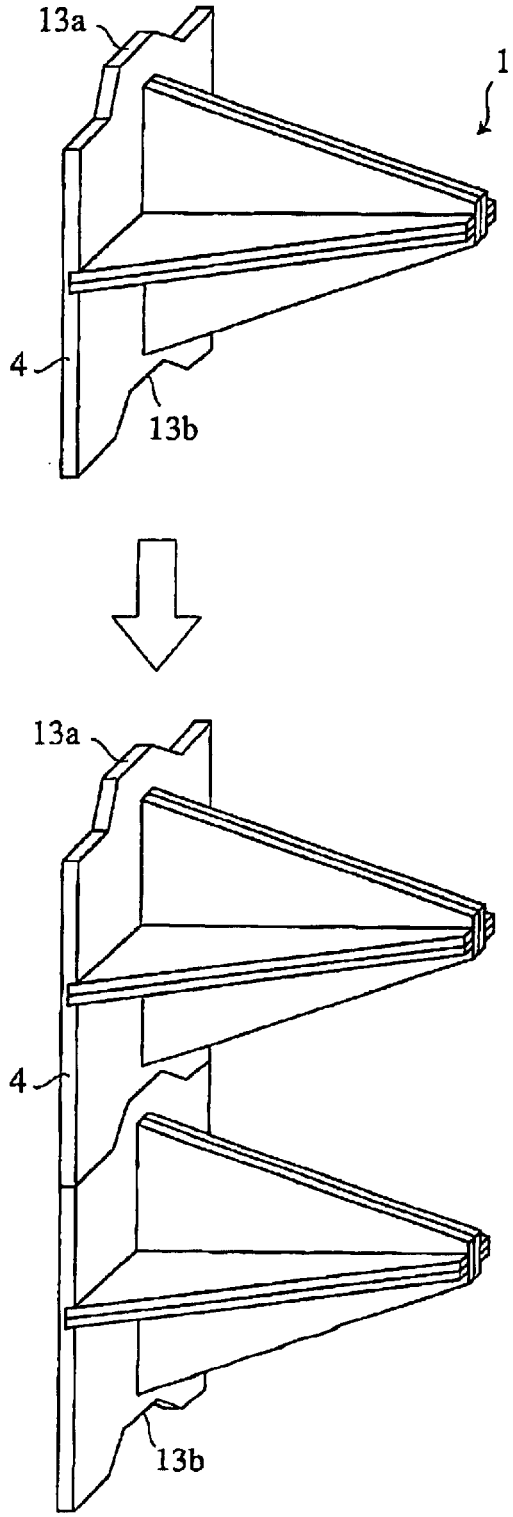
FIG. 4 is a perspective view showing a plurality of electromagnetic wave absorbers according to the present invention connected to each other.

As shown in FIG. 4, a plurality of the electromagnetic wave absorbers may be connected to each other by providing a convex portion 13*a* and a concave portion 13*b* on both sides of the base plate 4, and fitting the convex portion 13*a* of one base plate 4 into the concave portion 13*b* of the other base plate 4. The electromagnetic wave absorber of the present invention may be attached to a wall or a ceiling by fixing the base plate thereon beforehand and by assembling the wave-absorbing plates, the upper plate, etc. with the base plate. Another base plate having a convex portion and a concave portion may be disposed on the rear surface of the general, square-shaped base plate to be continuously connected.

Figure 5:
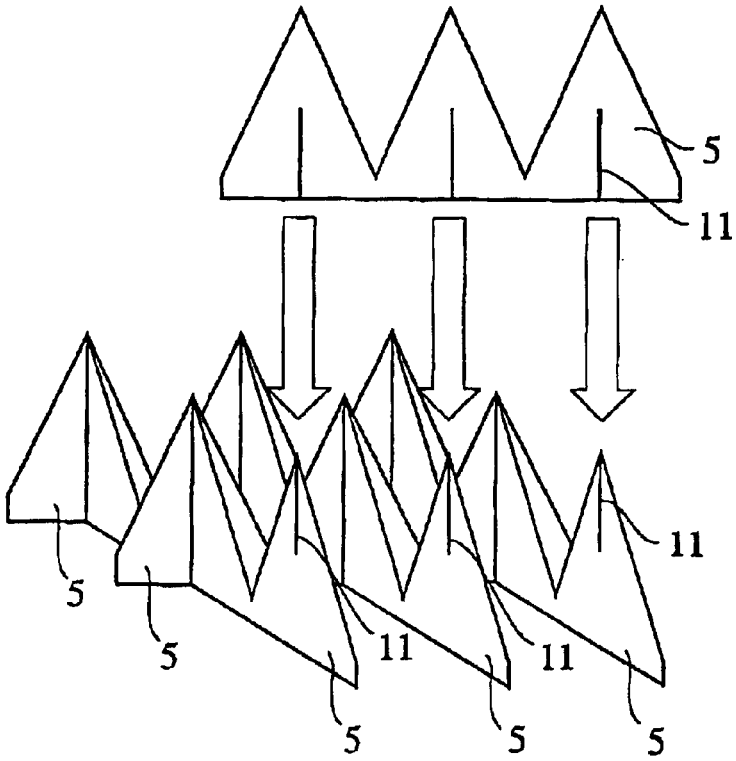
FIG. 5 is a perspective view showing production of an electromagnetic wave absorber of EXAMPLE 3 according to the present invention, wherein (a) shows wave-absorbing plates before fitting, and (b) shows the resultant electromagnetic wave absorber.
Figure 5:
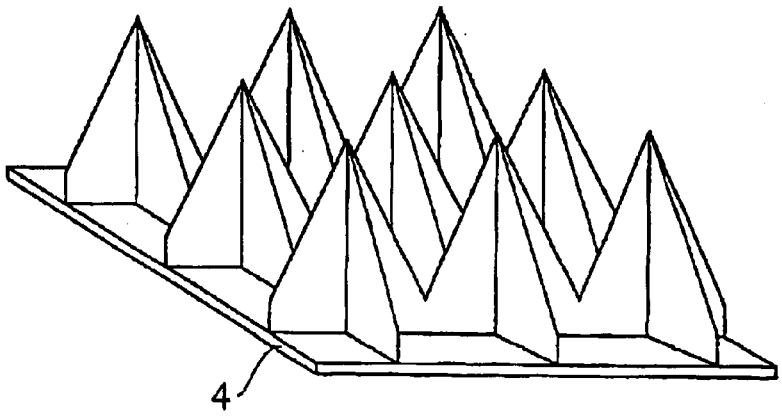
Figure 7:
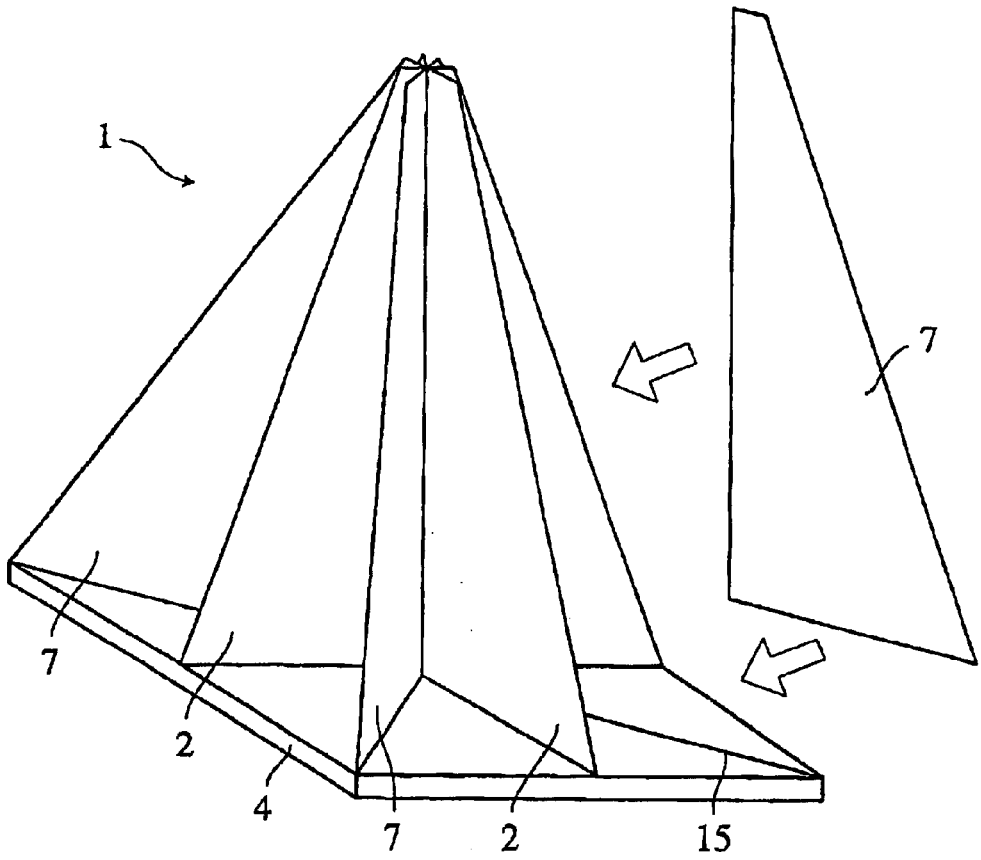
FIG. 7 is a perspective view showing production of an electromagnetic wave absorber of EXAMPLE 5 according to the present invention.

Although the wave-absorbing body is formed in a pyramid shape basically, various wave-absorbing bodies having suitably changeable apparent density, which is determined by a solid part and space in the wave-absorbing bodies, may be formed by controlling combination, size, etc. of the wave-absorbing plates. For example, the wave-absorbing body may be in a shape of continuously connected, partially overlapping pyramids as shown in FIG. 5. This wave-absorbing body may be formed by engaging wave-absorbing plates 5, each being continuously connected, partially overlapping triangles in shape, each other in a lattice pattern. As shown in FIG. 7, the wave-absorbing body may be formed by radially fitting the trapezium-shaped, wave-absorbing plates 7 into the base plate 4 to change the apparent density thereof.

Figure 6:
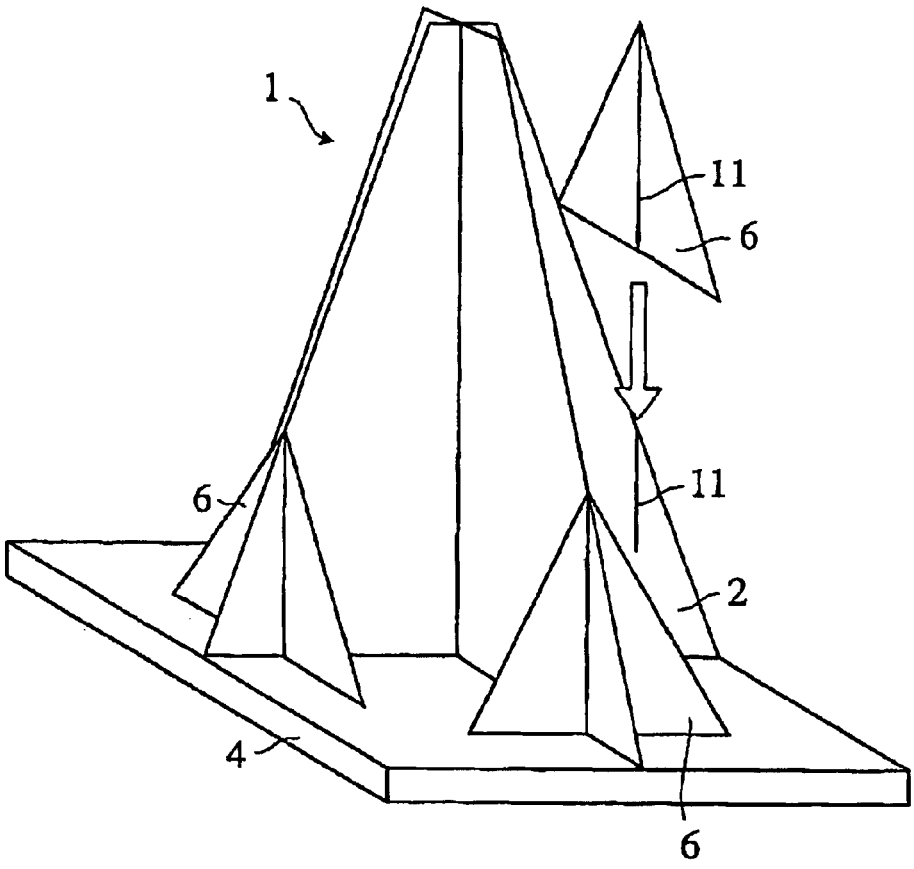
FIG. 6 is a perspective view showing production of an electromagnetic wave absorber of EXAMPLE 4 according to the present invention.
Figure 8:
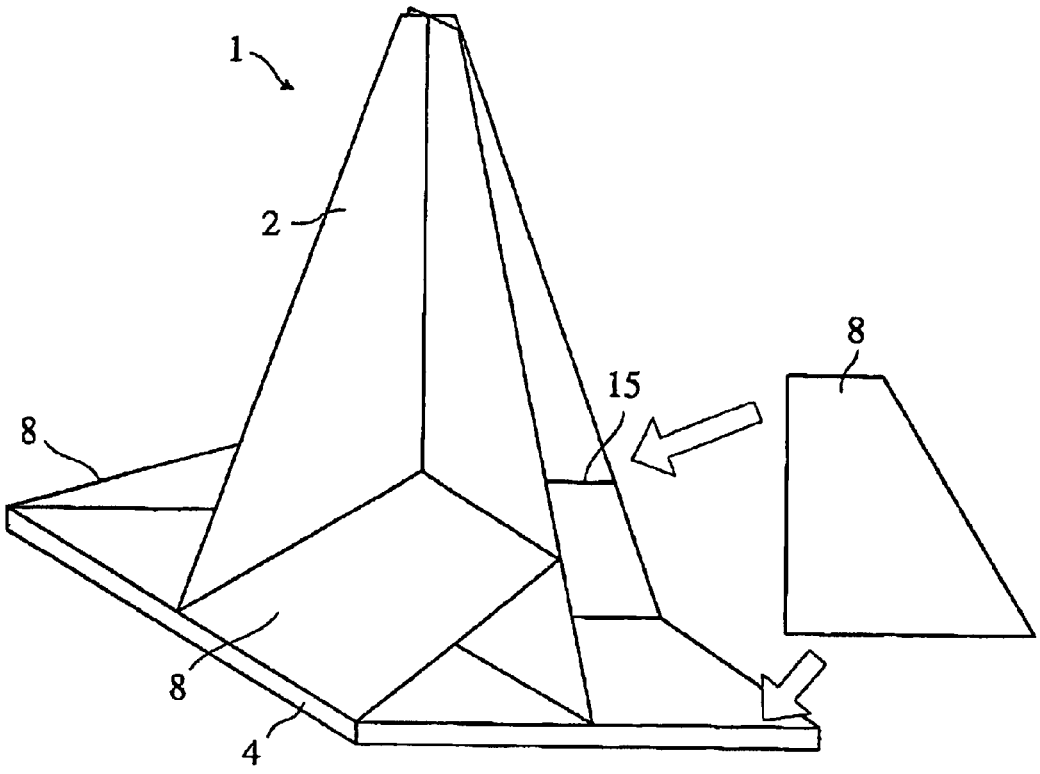
FIG. 8 is a perspective view showing production of an electromagnetic wave absorber of EXAMPLE 6 according to the present invention.
Figure 9:
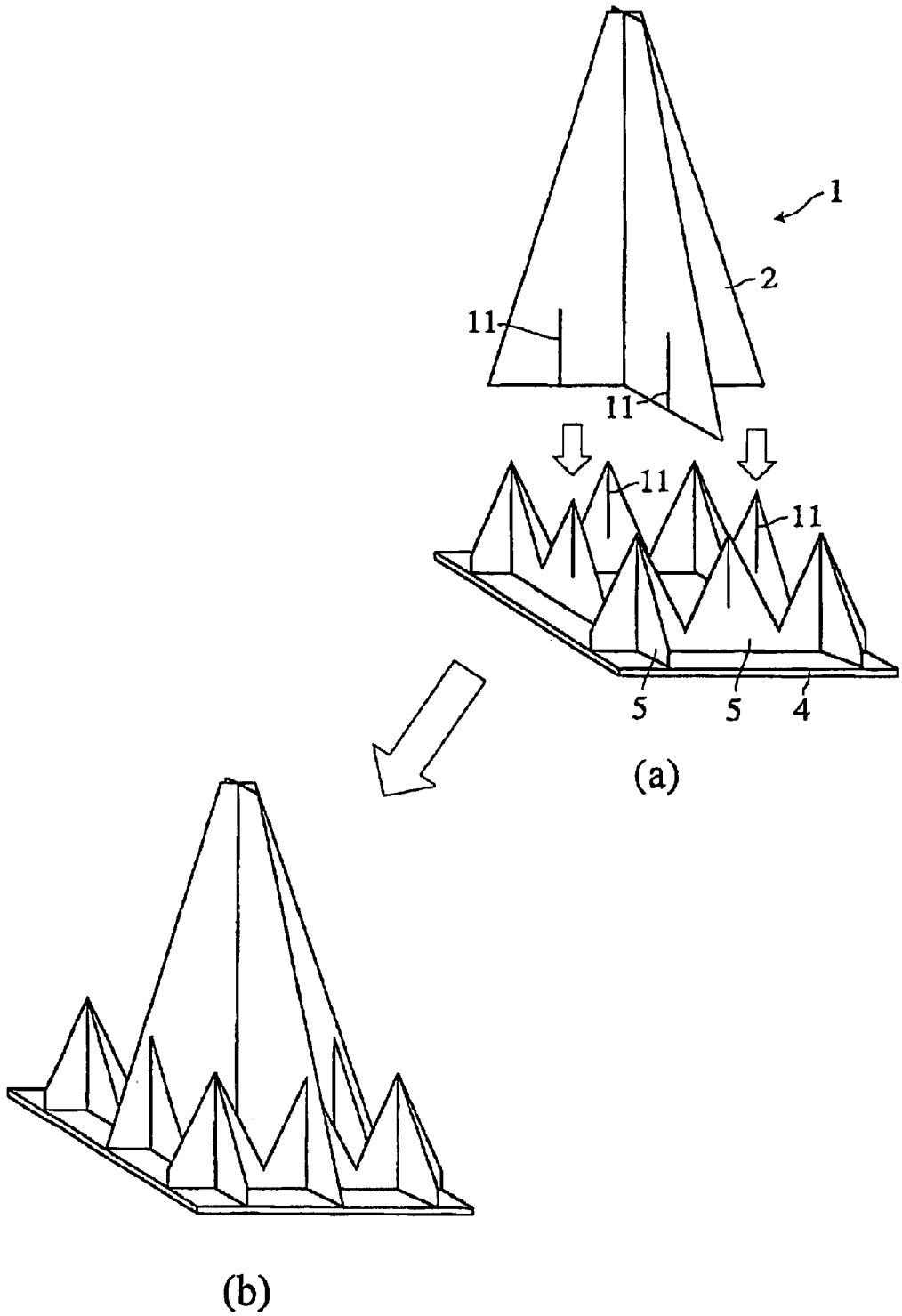
FIG. 9 is a perspective view showing production of an electromagnetic wave absorber of EXAMPLE 7 according to the present invention, wherein (a) shows wave-absorbing bodies before engaging and (b) shows the resultant electromagnetic wave absorber.
Figure 10:
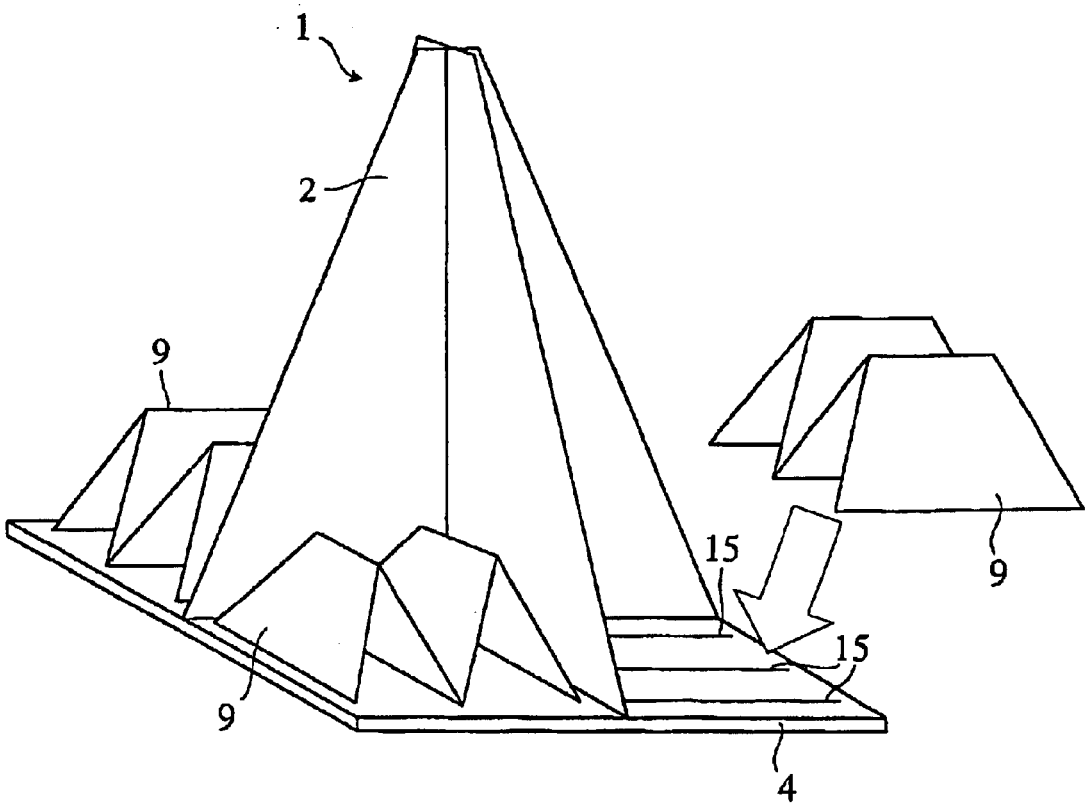
FIG. 10 is a perspective view showing production of an electromagnetic wave absorber of EXAMPLE 8 according to the present invention.
Figure 11:
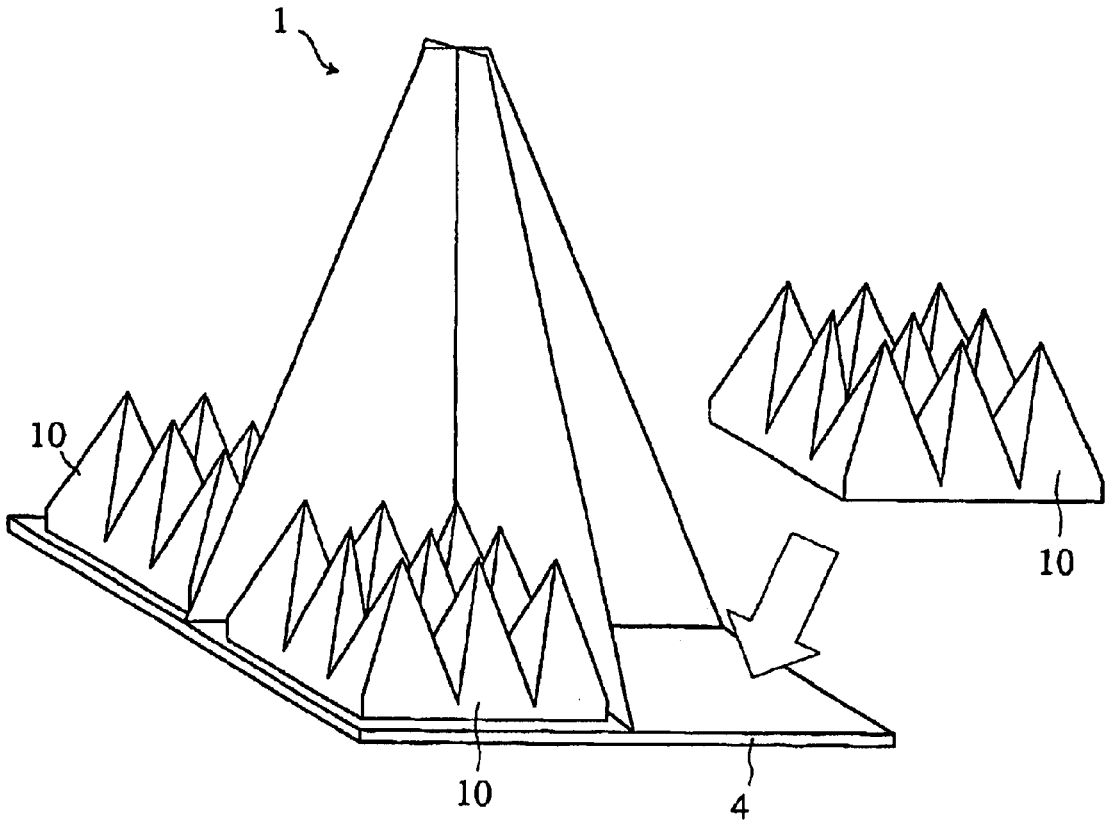
FIG. 11 is a perspective view showing production of an electromagnetic wave absorber of EXAMPLE 9 according to the present invention.

Further, as shown in FIGS. 6 and 9, the electromagnetic wave absorber may further comprise a shorter wave-absorbing body formed of the wave-absorbing plates 6 or 5 each having notches 11 in addition to the wave-absorbing body 1. As shown in FIGS. 8, 10 and 11, a wave-absorbing plate 8, a wedge-shaped, wave-absorbing body 9, a shorter pyramid-shaped, wave-absorbing body 10, etc. may be used in combination with the wave-absorbing body 1.

Figure 12:
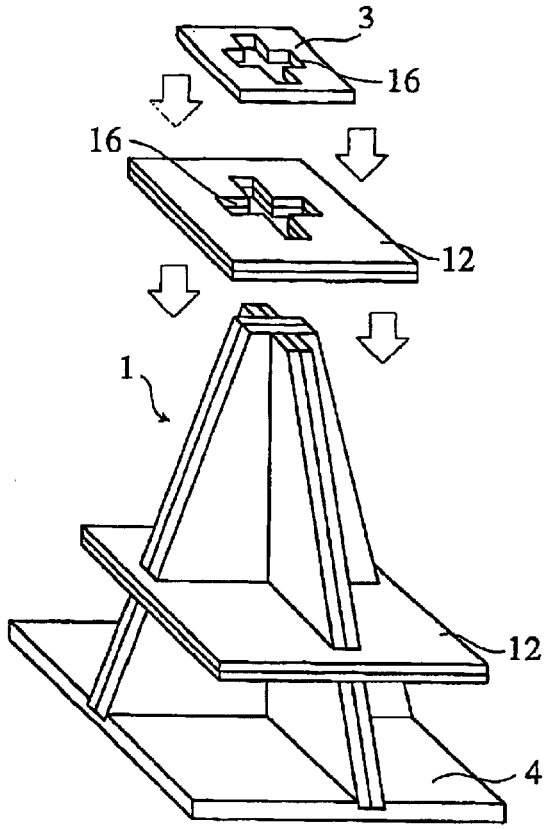
FIG. 12 is a perspective view showing production of an electromagnetic wave absorber of EXAMPLE 10 according to the present invention, wherein (a) shows wave-absorbing plates and an upper plate before fitting and (b) shows the resultant electromagnetic wave absorber.
Figure 12:
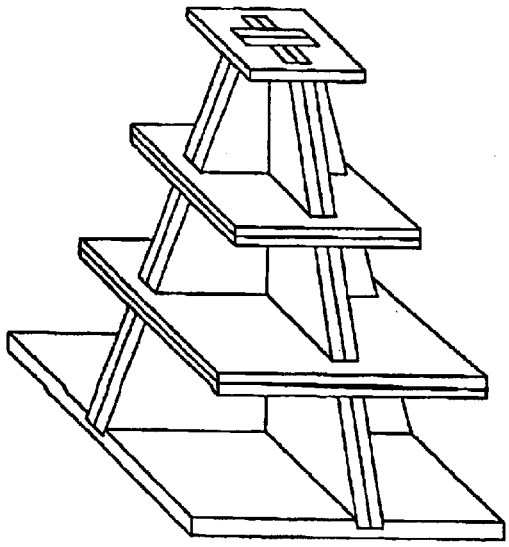

Furthermore, as shown in FIG. 12, with the wave-absorbing body 1 may be assembled a plurality of wave-absorbing plates 12 parallel to the base plate 4. The wave-absorbing plate 12 efficiently acts to change impedance correspondingly to the incident electromagnetic waves, thereby improving the electromagnetic wave absorption characteristics of the absorber. The number of the wave-absorbing plate 12 may be appropriately set depending on operating conditions and circumstances. Controlling the carbon-content of each wave-absorbing plates 12 enables to make them equal in size. A plate made of a material that reflects few electromagnetic waves may be assembled with the wave-absorbing body to improve the strength thereof.

The wave-absorbing body used in the present invention has a pyramid shape ideal for changing the apparent density, enabling match impedance to the incident electromagnetic waves. The apparent density is more preferably changed by appropriately selecting the shape or number of the wave-absorbing plates and/or the method for assembling the plates. Additionally, the electromagnetic wave absorber of the present invention may be used in combination with a ferrite tile, The ferrite tile is preferably mounted to the bottom surface of the base plate. The electromagnetic wave-absorbing properties of the electromagnetic wave absorber may be matched to that of the ferrite tile absorber by appropriately selecting composition thereof. Thus, the electromagnetic wave-absorbing properties of the entire absorber can be improved in the wide frequency range.

The electromagnetic wave absorber of the present invention has a larger surface area than those of the conventional pyramid-shaped absorbers to show a high heat-dissipating efficiency and an excellent heat resistance, thereby preventing the temperature elevation of the absorber even when the electromagnetic waves with strong electric field are radiated.

The electromagnetic wave absorber according to the present invention will be described in detail below with reference to FIGS. 2 to 11.

EXAMPLE 1

Carbon powder was mixed with a polypropylene resin, and the resultant mixture was shaped into a carbon sheet having a thickness of 1 mm. After an adhesive was applied to both surfaces of the carbon sheet, the carbon sheet was sandwiched between a couple of lightweight, non-combustible boards having a thickness of 10 mm. Immediately thereafter, the resultant laminate was pressed at 100 kg/cm$^2$ or less to prepare a non-combustible plate having a width of 900 mm, a length of 1800 mm and a thickness of 22 mm for use as a wave-absorbing plate. Incidentally, the lightweight, non-combustible board was made of a foamed material mainly composed of calcium carbonate.

Two non-combustible plates obtained above were cut into a trapezium-shape with an upper base of 100 mm, a lower base of 600 mm and a height of 1200 mm, and notches 11 having a width of 22.5 mm were provided in the upper base of one plate and the lower base of another plate, to prepare wave-absorbing plates 2 shown in FIG. 2(*a*). Then, the notches of the wave-absorbing plates 2 were engaged each other so that the wave-absorbing plates 2 are assembled in a cross shape, thereby forming a pyramid-shaped wave-absorbing body 1 shown in FIG. 2(*b*). An upper plate 3 was disposed on the top of the wave-absorbing body 1, and a base plate 4 was disposed on the bottom thereof to obtain an electromagnetic wave absorber shown in FIG. 2(*c*). The upper plate 3 and the base plate 4 were made of the lightweight, non-combustible board. The upper plate 3 and the base plate 4 had a cross-shaped opening 16 or a cross-shaped groove 15, and the wave-absorbing body 1 was inserted and fixed thereto. Incidentally, each part was adhered to one another by an adhesive, and the same is true in the following Examples.

EXAMPLE 2

The non-combustible plate prepared in EXAMPLE 1 was cut into two trapezium-shaped plates each having an upper base of 40 mm, a lower base of 300 mm and a height of 1200 mm. At the center of one trapezium-shaped plate were provided two fitting-apertures 12 and at the bottom thereof were provided two convex portions 13 to be inserted into openings 16 of the base plate 4, and the other trapezium-shaped plate was split in two and at the side and bottom thereof were provided convex portions 13, whereby wave-absorbing plates 2 and 2*a* shown in FIG. 3 were prepared. The convex portions 13 of the wave-absorbing plate 2*a* were fitted into the fitting-apertures 12 of the wave-absorbing plate 2, and an upper plate 3 and a base plate 4 were disposed on the resultant wave-absorbing body in the same manner as in EXAMPLE 1 to obtain an electromagnetic wave absorber. Incidentally, the upper plate 3 used in EXAMPLE 2 was in a cross-shape suitable for the shape of the top of the wave-absorbing body.

In the structures in EXAMPLES 1 and 2, the wave-absorbing body having a pyramid shape, ideal for changing the apparent density to match impedance to the incident electromagnetic waves, can be easily formed by combining only two wave-absorbing plates. Thus, according to the present invention, the parts composing the absorber can be reduced without deterioration of the electromagnetic wave-absorbing properties to remarkably reduce production costs. Additionally, the electromagnetic wave absorber of the present invention can be easily applied even when its height is more than 1 m because most of the parts composing the absorber are lightweight plates, resulting in reducing construction costs. Further, the parts may be transported in a plate-shape because the electromagnetic wave absorber according to the present invention can be easily assembled at a construction site without particular tools, thereby reducing transporting costs.

EXAMPLE 3

Six wave-absorbing plates 5 shown in FIG. 5(*a*), which were in a shape of continuously connected three triangles with a base of 200 mm and a height of 450 mm each having notches 11 with a width of 22.5 mm in the top or the center of the bottom, were prepared of the non-combustible plate obtained in EXAMPLE 1. The notches 11 of the wave-absorbing plates 5 were engaged each other, such that the wave-absorbing plates 5 are made integral in a lattice pattern. On the bottom of the resultant wave-absorbing body having a shape of continuously connected, partially overlapping pyramids was disposed a base plate 4 to obtain an electromagnetic wave absorber shown in FIG. 5(*b*).

A plurality of absorbers are needed when a conventional electromagnetic wave absorber with a small base area is applied to a predetermined area, thereby increasing production steps and costs. For example, in a case where a pyramid-shaped absorber is applied to an area of 60 cm around, only one absorber is needed when it has a base of 60 cm around, and nine absorbers are needed when it has a base of 20 cm around. In contrast, because the electromagnetic wave absorber according to EXAMPLE 3 has a structure where the pyramids are continuously connected, both the numbers of parts and assembling processes can be reduced. The electromagnetic wave absorber constituted by a plurality of units integrally connected to each other can be efficiently assembled to form a panel.

EXAMPLE 4

Four wave-absorbing plates 6 shown in FIG. 6, which were in a shape of triangle with a base of 300 mm and a height of 450 mm having a notch 11 with a width of 22.5 mm in the center of the base, were prepared of the non-combustible plate obtained in EXAMPLE 1. The wave-absorbing plates 6 and the wave-absorbing body 1 formed in the same manner as in EXAMPLE 1, which was provided notches 11 of 22.5 mm in width on each hypotenuse, were engaged each other through the notches, and a base plate 4 was disposed on the bottom thereof to obtain an electromagnetic wave absorber.

EXAMPLE 5

Four wave-absorbing plates 7 shown in FIG. 7, which were in a shape of a trapezium with an upper base of 40 mm, a lower base of 400 mm and a height of 1200 mm, were prepared of the non-combustible plate obtained in EXAMPLE 1. The wave-absorbing plates 7 were fitted into the wave-absorbing body 1 formed in the same manner as in EXAMPLE 1, and a base plate 4 was disposed on the bottom thereof to obtain an electromagnetic wave absorber. On the base plate 4 were provided grooves 15 to which the wave-absorbing plates 7 could be fixed beforehand, so that they could be stably fitted with ease.

EXAMPLE 6

Four wave-absorbing plates 8 shown in FIG. 8, which were in a shape of a trapezium with an upper base of 200 mm, a lower base of 280 mm and a height of 400 mm having a side perpendicular to both bases, were prepared of the non-combustible wave-absorbing plate obtained in EXAMPLE 1. The wave-absorbing plates 8 were leaned on and fitted to the wave-absorbing body 1 formed in the same manner as in EXAMPLE 1, and a base plate 4 was disposed on the bottom of the wave-absorbing body 1 to obtain an electromagnetic wave absorber. On the wave-absorbing plates 2 and the base plate 4 were provided grooves 15 to which the wave-absorbing plates 8 could be fixed beforehand, so that they could be stably fitted with ease.

In EXAMPLES 4 to 6, the apparent density of the electromagnetic wave absorber increases as the number of the wave-absorbing plates increases to control impedance. This improves the electromagnetic wave-absorbing properties in a high frequency range.

EXAMPLE 7

Four wave-absorbing plates 5 shown in FIG. 9(*a*) each having notches 11 were engaged each other to obtain a shorter wave-absorbing body, and a base plate 4 was disposed on the bottom thereof. On the base plate 4 were provided grooves (not shown) to be engaged with wave-absorbing bodies beforehand. The wave-absorbing body 1 formed in the same manner as in EXAMPLE 1 was provided with 22.5-mm-wide notches 11, which were then engaged with the notches 11 of the shorter wave-absorbing body to obtain an electromagnetic wave absorber shown in FIG. 9 (*b*).

EXAMPLE 8

As shown in FIG. 10, a base plate 4 was disposed on the bottom of the wave-absorbing body 1 formed in the same manner as in EXAMPLE 1, and wedge-shaped, wave-absorbing bodies 9 were assembled with the base plate 4 to obtain an electromagnetic wave absorber. The wedge-shaped, wave-absorbing body 9 was formed by bending a polygonal, non-combustible wave-absorbing plate several times into a double wedge shape. Specifically, the wave-absorbing body 9 having a length of 300 mm and a width of 150 mm was in a tapered double wedge shape where each wedge had a base of 150 mm and a height of 300 mm. On the base plate 4 were provided grooves 15 to which the wave-absorbing body 1 and the wedge-shaped, wave-absorbing bodies 9 could be fixed beforehand, so that they could be stably fitted with ease.

EXAMPLE 9

As shown in FIG. 11, a base plate 4 was disposed on the bottom of the wave-absorbing body 1 formed in the same manner as in EXAMPLE 1, and shorter wave-absorbing bodies 10 were assembled with the base plate 4 to obtain an electromagnetic wave absorber. The shorter wave-absorbing body 10 was in a shape of continuously connected, partially overlapping nine pyramids, each pyramid having a base of 100 mm×100 mm and a height of 300 mm. The wave-absorbing body 10 was prepared by molding a foamed urethane resin penetrated with a carbon, and fixed to the base plate 4 by adhering. Although the wave-absorbing body 10 may be formed of the wave-absorbing plates, this suffers disadvantage that the number of forming processes is increased. Such a wave-absorbing body may have a wedge-shape, etc.

EXAMPLE 10

As shown in FIG. 12(*a*), a base plate 4 was disposed on the bottom of the wave-absorbing body 1 formed in the same manner as in EXAMPLE 1, and wave-absorbing plates 12 with a thickness of 22 mm, each having a cross-shaped opening 16, were assembled with the wave-absorbing body 1 to be parallel to the base plate 4. The wave-absorbing plates 12 were 450 mm×450 mm and 300 mm×300 mm in size, respectively. Then, an upper plate 3, which was composed of a lightweight non-combustible board of 200 mm×200 mm in size and had a cross-shaped opening 16 in the center, was fitted with the top of the wave-absorbing body 1 to obtain an electromagnetic wave absorber shown in FIG. 12(*b*).

Each of the electromagnetic wave absorbers of EXAMPLES 7 to 10 comprises a shorter wave-absorbing body formed in a shape of a pyramid, a wedge or continuously connected, partially overlapping pyramids in addition to the wave-absorbing body 1 prepared in EXAMPLE 1. The electromagnetic wave-absorbing properties in a high frequency range are improved as well as the absorbers of EXAMPLES 4 to 6.

While the electromagnetic wave absorber according to the present invention has been described in detail, it is to be understood that the invention is not limited thereto, and may be otherwise embodied within the scope of the appended claims. For example, the wave-absorbing plate may be used in a shape of a tapered pentagon, etc., or above-mentioned shorter wave-absorbing body may be conical.

As described in detail above, an electromagnetic wave absorber of the present invention comprises a wave-absorbing body formed by fitting (or engaging) a plurality of wave-absorbing plates each having a shape of a polygon such as a triangle, a trapezium, etc., and a base plate supporting the bottom thereof. The wave-absorbing body having a pyramid shape ideal for matching impedance to the incident electromagnetic waves can be formed without deterioration of the electromagnetic wave-absorbing properties. Further, according to the present invention, the number of the parts composing the absorber is reduced. Therefore, great reduction is achieved in production costs and the absorber can be easily assembled in construction site to reduce construction costs and transporting costs. Furthermore, by using the wave-absorbing plate composed of a couple of lightweight, non-combustible boards and an electrically conductive layer sandwiched therebetween, a flame retardant electromagnetic wave absorber can be obtained with ease.

What is claimed is:

1. An electromagnetic wave absorber comprising a wave-absorbing body and a base plate supporting the bottom of said wave-absorbing body, wherein said wave-absorbing body is formed in a pyramid shape by fitting polygonal wave absorbing plates into other, wherein said wave-absorbing body is formed by fitting a polygonal wave-absorbing plate having a notch in an upper portion and polygonal wave-absorbing plate having a notch in a lower portion into each other through said notches in a crossing manner.

2. The electromagnetic wave absorber according to claim 1, wherein said wave-absorbing body is constituted by a plurality of first polygonal wave-absorbing plates each having a notch in an upper portion and a plurality of second polygonal wave-absorbing plates each having a notch in a lower portion, each plate being in a shape of a continuously connected, partially overlapping polygons, said first polygonal wave-absorbing plates and said second polygonal wave-absorbing plates engaging each other through their notches in a lattice pattern, such that said wave-absorbing body has a shape of continuously connected, partially overlapping pyramids.

3. The electromagnetic wave absorber according to claim 1, further comprising a shorter w wave-absorbing body formed in a shape of a pyramid, a wedge or continuously connected partially overlapping pyramids.

4. The electromagnetic wave absorber according to claim 1, wherein the bottom surface of said base plate is provided with a ferrite tile.

5. The electromagnetic wave absorber according to claim 1, wherein said wave-absorbing plate is in a shape is a triangle, a trapezium or a tapered polygon.

6. The electromagnetic wave absorber according to claim 1, wherein said wave-absorbing plate is composed of a couple of non-combustible boards mainly made of an inorganic material and an electrically conductive layer sandwiched therebetween.

7. The electromagnetic wave absorber according to claim 6, wherein said electrically conductive layer is an electrically conductive sheet made of carbon powder or fiber dispersed in a resin.

* * * * *